United States Patent [19]

Bourlet

[11] 4,112,817

[45] Sep. 12, 1978

[54] SUPPLY DEVICE FOR A PORTABLE FIREARM BY MEANS OF CARTRIDGE BELTS OR BY MEANS OF RIFLE MAGAZINES USING THE SAME AMMUNITION

[75] Inventor: Maurice V. Bourlet, Liege, Belgium

[73] Assignee: Fabrique Nationale Herstal S.A. en abrégé FN, Herstal, Belgium

[21] Appl. No.: 788,342

[22] Filed: Apr. 18, 1977

[30] Foreign Application Priority Data

Jun. 23, 1976 [BE] Belgium ..... 255131

[51] Int. Cl.[2] ..... F41D 9/02

[52] U.S. Cl. ..... 89/33 B; 89/33 C

[58] Field of Search ..... 89/33 R, 33 B, 33 BB, 89/33 BC, 33 C, 33 CA

[56] References Cited

U.S. PATENT DOCUMENTS 3,875,845 4/1975 Hupp et al. ..... 89/33 CA

*Primary Examiner*—Stephen C. Bentley

*Attorney, Agent, or Firm*—Bacon & Thomas

[57] ABSTRACT

The invention pertains to a device for supplying portable arms by means of cartridge belts and by means of rifle magazines using the same ammunition, characterized by the fact that the weapon is provided with a lateral opening, extended by a sleeve which can serve the purpose of guide for a magazine, aforesaid sleeve being fitted with a flap which is conditioned in such a manner that it can close aforesaid sleeve and be used as guide for the cartridge belt, the bolt having two tenons, one of which is used to act upon the cartridges of a belt, one by one, and the other operating to act, one by one, upon the cartridges of a magazine.

5 Claims, 10 Drawing Figures

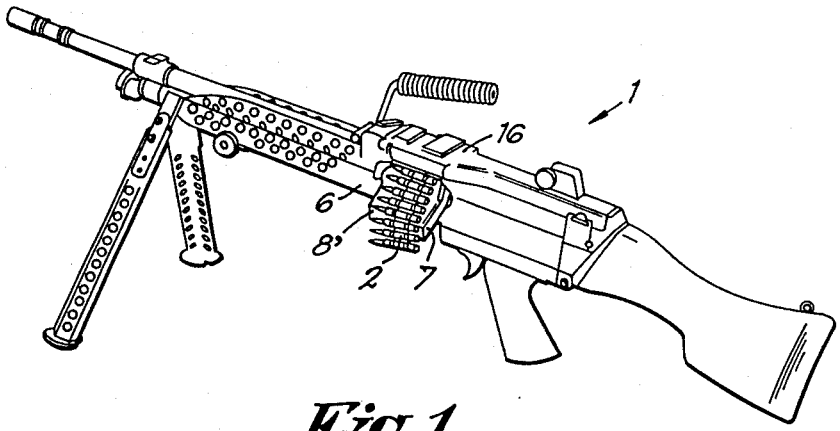
Fig. 1
Fig. 2
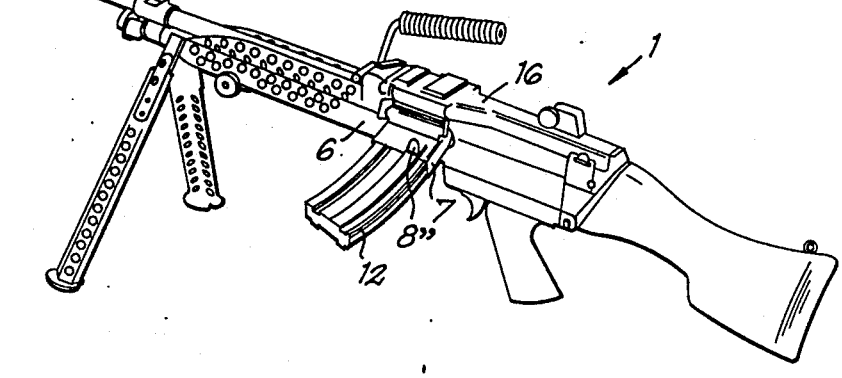

SUPPLY DEVICE FOR A PORTABLE FIREARM BY MEANS OF CARTRIDGE BELTS OR BY MEANS OF RIFLE MAGAZINES USING THE SAME AMMUNITION

The present invention pertains to the modern portable firearms which are normally conditioned to be supplied by cartridge belts. More particularly, the invention is concerned with such arms, such as machine guns, provided with a rotary locking mechanism for instance in a subsidiary part of the barrel, whereby the unlocking is effected by a gas tapping. A piston which is integral with the slide is pushed towards the rear by the gas pressure, while a gradient on the slide which engages a tenon of the bolt performs the unlocking and makes the extraction and the ejection of the shell possible. After the rearward stroke, a recuperator spring, compressed by the piston, sends the parts back towards the front. At this moment, the supply system which is contained in the cover has advanced the belt, so that there is now a cartridge on the track, ready to be fed. The bolt which slides in its rails, which are fixed in the casing, then pushes the cartridge by means of a tenon into the breech.

It shall be noted that modern machine guns, due to their light weight and handling facility, are liable to be used in military units in which the individual arms fire similar ammunition to that used in the supply by means of cartridge belts.

This ammunition being fed by magazines, it is of interest for a machine gun, after having exhausted its supply of belts, to be able to continue to operate while being supplied, for instance, by a rifle magazine.

Over the above the interest offered by the double supply device, it is also important that, despite the more elaborate equipment, the aiming system of the weapon need not be altered.

These various conditions according to the invention are fulfilled due to the fact that, starting from a modern machine gun, the weapon has a side opening for access to a magazine, the opening being extended by a sleeve which can serve the purpose of a guide for aforesaid magazine, aforesaid sleeve being provided with a flap, hingedly attached to aforesaid magazine guide, so as to be able to close said sleeve and serve as a guide for the cartridge belt.

Complementarily, the shaping of the bolt has been altered so as to present two pressure tenons, one for loading from cartridge belts and the other for the loading from magazines.

These novel elements have the possibility of being built in various shapes and in variable relative locations.

Merely as a non-limiting example, a form of embodiment is described hereinafter in greater detail, with reference to the appended drawings in which:

FIG. 1 schematically shows a perspective view of a weapon supplied by cartridge belts;

FIG. 2 is similar to FIG. 1, the same weapon being however supplied by a magazine;

Figure 3:
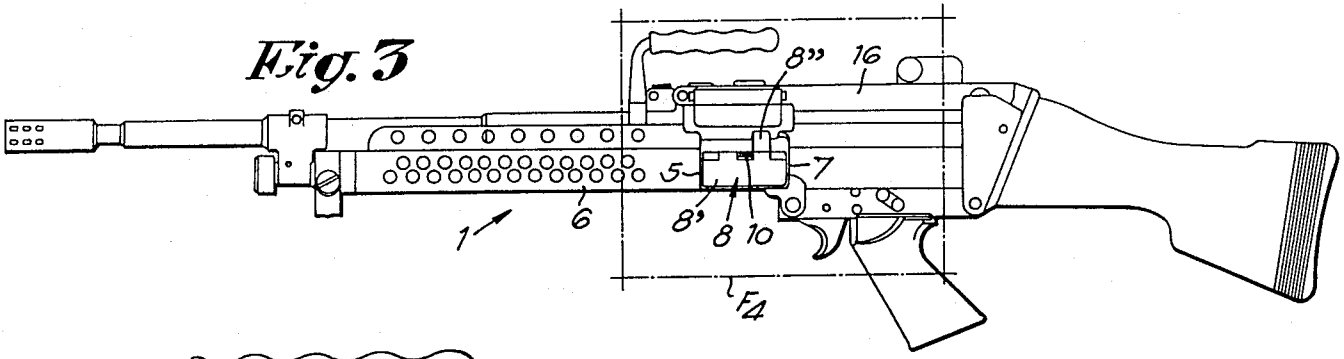
FIG. 3 is a side view, to a larger scale, of the weapon according to FIGS. 1 and 2, but without a supply device.
Figure 5:
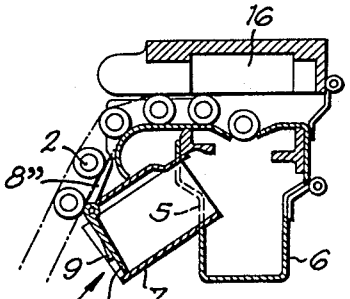
FIG. 5 shows a section according to line V—V of FIG. 4.
Figure 4:
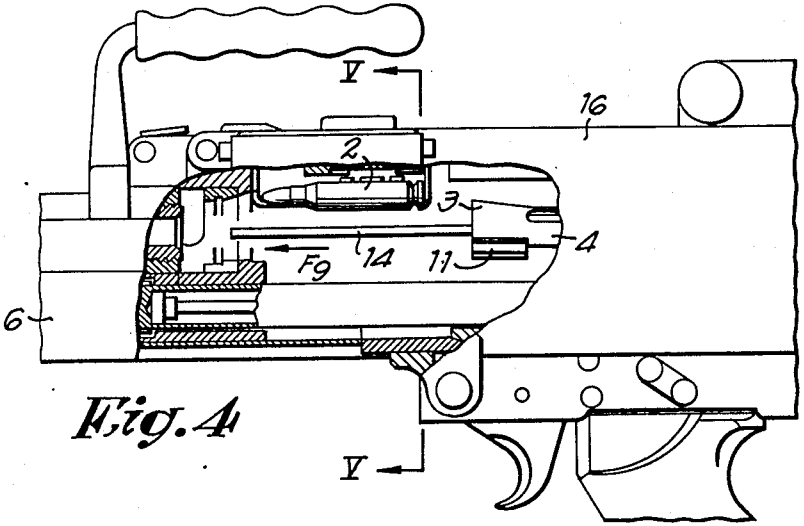
FIG. 4 is an enlarged view of that part of FIG. 3 indicated by F4.
Figure 7:
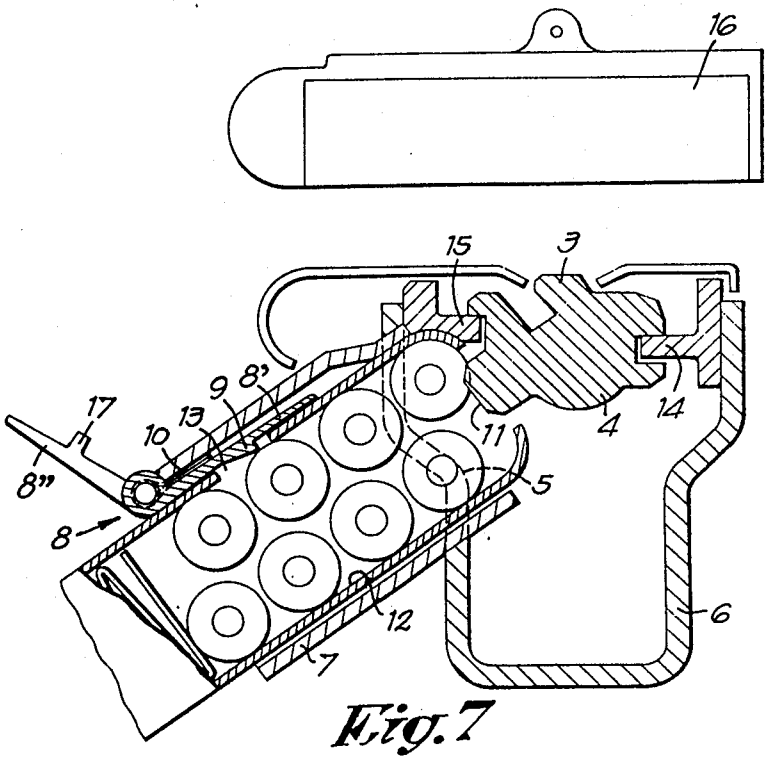
FIG. 7 is similar to FIG. 6, the weapon being shown as supplied by a magazine.

In this form of embodiment, we start off with a modern machine gun 1 of the type which is conditioned to be fed by a cartridge belt. In the present case, the means which permit that sort of supply subsist and are consequently characteristic of the known machine guns. The cartridges 2 are forwarded in the usual manner towards the loading device and are pushed on, one at a time, by tenon 3 of bolt 4.

According to the invention, an opening 5 has in this case been provided in the left hand side of casing 6 of the weapon. This opening 5 is extended by a sleeve 7 which is intended to serve as a magazine guide. At the entrance to sleeve 7, an approximately L shaped flap 8 is hingedly attached. Branch 8′ of aforesaid flap has a tooth 9 and the flap is urged toward closed position by an elastic element 10. In this case, bolt 4 is provided with an extra tenon 11.

Figure 6:
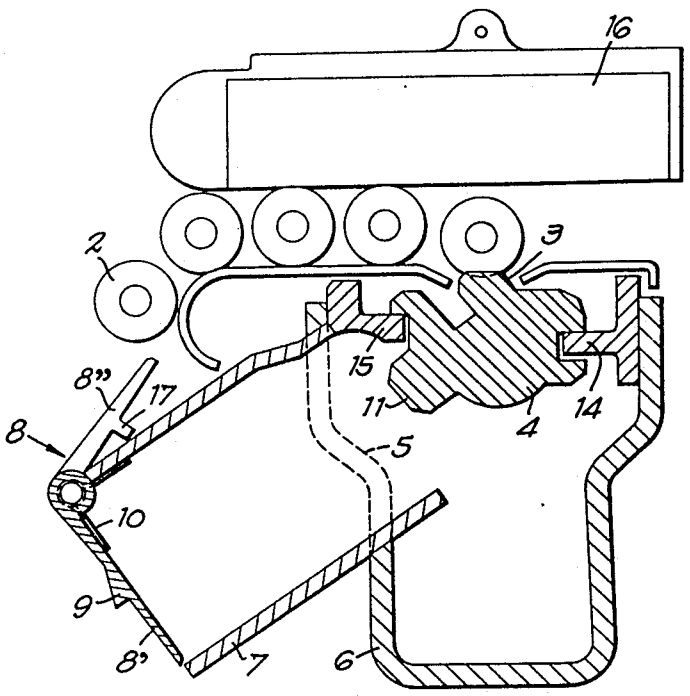
FIG. 6 is similar to FIG. 5, the bolt being in the supply phase by means of cartridge belts.
Figure 9:
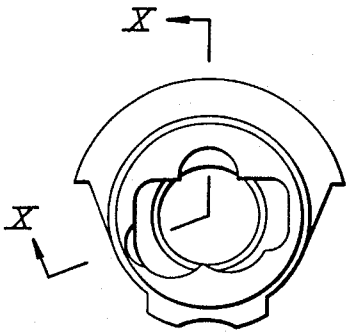
FIG. 9 is a view in the direction of arrow F9 in FIG. 4, more particularly showing the locking ring of the barel.
Figure 10:
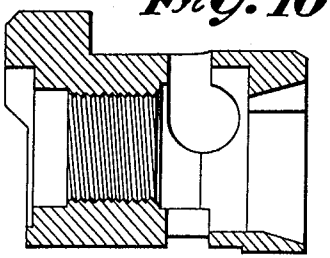
FIG. 10 shows a section according to line X—X in FIG. 9.
Figure 8:
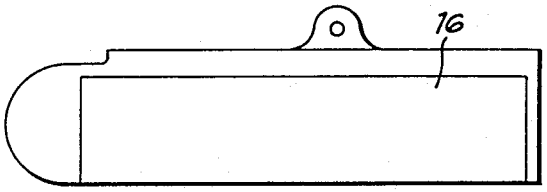
FIG. 8 is similar to FIG. 7, illustrating the alternate loading when using a magazine.
Figure 8:
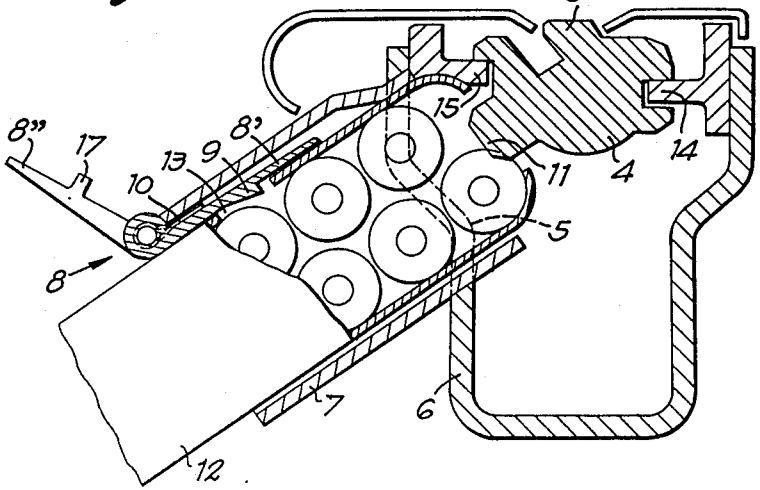

In the position illustrated in FIG. 6, sleeve 7 is closed by branch 8′ of flap 8, the second branch 8″ of the flap being directed towards the belt, so as to form a guide facilitating the regular forwarding of the successive rounds aligned on the belt.

In the magazine feed position, it will be sufficient to insert a normal rifle magazine 12 into sleeve 7, whereby flap 8 is automatically pushed back. The magazine will be held in place by aforementioned tooth 9 which registers with a corresponding opening 13 in magazine 2.

It will be seen that bolt 4 and the arrangement of guide rails 14–15 have been altered so as to assure the normal and successive action upon the cartridges.

It is quite obvious, that during the loading movements of the cartridges, the supply system contained in cover 16 continues to operate in idleness.

A main characteristic further consists in the fact that the magazine is placed laterally and not vertically on cover 16. This arrangement permits the sighting line to remain unaltered and considerably simplifies the fitting of aiming accessories such as telescopic sights, a reflex collimator, a light amplifier or others.

It must further be noted, that the closing flap 8 of the magazine guide has a double function. It is first used to close opening 5 in casing 6 so as to assure a better sealing of the weapon, and it further serves as stop for the magazine when inserted into aforesaid sleeve 7.

A further remarkable fact is the possibility of passing instantaneously, either to belt feed or to magazine feed.

In order to limit the angular movement of said flap 8, branch 8″ of the latter is provided with a tenon 17 which normally, and in the closed position of aforesaid flap 8, comes into contact with the corresponding part of sleeve 7.

The invention is concerned with the device itself, as well as with all weapons equipped with such a device, such as machine guns, rifles and suchlike.

What I claim is:

1. Device for supplying portable arms by means of cartridge belts or by means of rifle magazines using the same ammunition, characterized by the fact that the weapon is provided with a lateral opening extended by a sleeve which serves as guide for a magazine, aforesaid sleeve being fitted with a flap which is conditioned in such a manner as to be able to close aforesaid sleeve and to serve as guide for the cartridge belt, the bolt having at least two tenons, one of which is used to act, one by one, upon the cartridges of a belt, and the other being used to act, one by one, upon the cartridges of a magazine.

2. Device according to claim 1, characterized by the fact that aforesaid flap is of approximate L shape and is hingedly fitted on a pivot pin of the sleeve, aforesaid flap being permanently urged towards its closed position by an elastic device.

3. Device according to claim 2, characterized by the fact that one branch of the L shaped flap is fitted with a tooth which is capable of cooperating with an appropriate opening in the magazine, so as to maintain the latter in said sleeve.

4. Device according to claim 2, characterized by the fact that the second branch of the approximately L shaped flap has, on one of its surfaces, a protrusion which is capable of limiting the angular movement which brings the first branch of aforesaid flap to its closed position.

5. Device according to claim 2, characterized by the fact that the angular spacing between the two branches of the approximately L shaped flap is such, that one of the branches of said flap functions as guide to the cartridge belt, when the other branch of aforesaid flap is in the correct closing position of the sleeve.

* * * * *